United States Patent [19]

Koehler et al.

[11] 4,191,937

[45] Mar. 4, 1980

[54] ELECTROMAGNET MAGNETIC CIRCUIT WITH PERMANENT-MAGNET ARMATURE

[75] Inventors: Gérard Koehler, Ville D'Avray; Jean Aguettaz, Paris; Alain Berthelot, Evreux; Claude Genter, Paris; Daniel Arnoux, St-Germain-en-Laye, all of France

[73] Assignee: Manufacture Francaise d'Appareils Electriques de Mesure, Conches-en-Ouche, France

[21] Appl. No.: 897,430

[22] Filed: Apr. 18, 1978

[30] Foreign Application Priority Data

Apr. 18, 1977 [FR] France ..... 77 11605
Jan. 24, 1978 [FR] France ..... 78 01912

[51] Int. Cl.[2] ..... H01F 7/08; H01H 51/22
[52] U.S. Cl. ..... 335/230; 335/79
[58] Field of Search ..... 335/229, 230, 231, 232, 335/233, 234, 78, 79, 80, 81, 82, 83, 84; 361/160

[56] References Cited

U.S. PATENT DOCUMENTS 2,864,038 12/1958 Ruhland et al. ..... 335/230
2,866,927 12/1958 Berg et al. ..... 335/230

*Primary Examiner*—Harold Broome

[57] ABSTRACT

A magnetic circuit comprising a fixed core, yokes having flat portions in parallel planes, and an armature comprising a permanent magnet provided with pole pieces having end portions projecting on either side of the magnet, a flat portion of a first one of said yokes penetrating into the space between two end portions of the pole pieces located on one side of the magnet axis, the air gap surfaces of said yokes and of said pole pieces extending normally to the magnet axis and, one the other side thereof, at least one projecting end portion of said pole pieces penetrating between two flat portions of second and third yokes carried by a same free end of the core. Such a magnetic circuit is suitable for monostable or bistable operation in relays, contactors or solenoid valves.

26 Claims, 25 Drawing Figures

ELECTROMAGNET MAGNETIC CIRCUIT WITH PERMANENT-MAGNET ARMATURE

BACKGROUND OF THE INVENTION

The present invention relates in general to a magnetic circuit for DC electromagnet such as a relay electromagnet, which comprises a fixed core, two yokes each connected to a respective free end of the core, and at least one armature movable between two end positions, said armature comprising a permanent magnet having flux input and output faces disposed at right angles to the magnet axis and each provided with a pole piece, each yoke having a flat portion having at least one air gap surface, the flat portions of the yokes being located in substantially parallel planes, said pole pieces having projecting end portions provided with air gap surfaces located on either side of the magnet axis, the flat portion of a first one of said yokes having two air gap surfaces and penetrating with a clearance corresponding to the armature stroke, between the two mutually facing air gap surfaces of the two end portions of the pole pieces located on a first side of the magnet axis.

DESCRIPTION OF THE PRIOR ART

A structure of this character is disclosed in French Pat. No. 2,358,006. The electromagnet described in this prior French patent is suitable for bistable and monostable operation, requiring only a minor modification in the magnetic circuit for changing from one mode of operation to the other mode. Its performances are satisfactory, notably from the point of view of the forces obtained at the end of the stroke, of the stroke itself, and of the power consumption necessary for its operation. However, a simultaneous closing of the air gaps cannot be obtained by using a variable stroke for taking up bending or machining tolerances, and a complete closing (in lieu of a wedge closing) of the air gaps requires an accurate grinding or machining of the air gap surfaces and the use of high-precision sections, thus increasing considerably the cost of the electromagnet.

Furthermore, since the forces are generated along a single axis, if reactions in actual service, such as contact reactions, occur at a certain distance from this axis, a torque is produced which tends to prevent the air gaps from closing completely.

Finally, it may be advantageous to dispose of magnetic circuits better suited for the replacement of existing models, in view of their interchangeability, such as electromagnets comprising two parallel coils, or a single coil disposed on the central arm of a lamination stamped to a "E" configuration.

SUMMARY OF THE INVENTION

It is the primary object of the present invention to provide a magnetic circuit structure for an electromagnet, notably for a relay, a contactor, or a solenoid-valve, adapted for monostable or bistable operation, at the cost of only a minor modifications in the magnetic circuit, this structure affording high performances while avoiding the shortcomings mentioned hereinabove.

To this end, the invention provides a magnetic circuit characterized in that the air gap surfaces of the end portions of the pole pieces and of the flat portions of the yokes extend at right angles to the magnet axis, the armature is movable for translation in a direction corresponding substantially to the magnet axis, and, on a second side of the magnet axis, a second one of said yokes and a third yoke, both supported by a common free end of the core, have flat portions provided with mutually facing air gap surfaces between which two air gap surfaces belonging to at least one of the two pole pieces penetrate with a clearance substantially equal to the above-mentioned clearance.

According to a first embodiment of this invention, which corresponds to a bistable operation mode, on the second side of the magnet axis, the flat portions of the second and third yokes, having mutually facing air gap surfaces, are so spaced from each other that the end portions of the two pole pieces each provided with an external air gap surface penetrate, with substantially the said clearance, between the flat portions of said second and third yokes, whereby, for each end position of the armature, the magnetic flux of the magnet is caused to flow through the core, the pair of yokes and two air gaps disposed on either side of the magnet axis and closed for a same direction of the movement of translation of the armature, so that the direction of flow of the magnetic flux through the core is inverted when the armature is moved from one end position to the other end position.

According to a second embodiment of the invention, corresponding to monostable operation mode, on the second side of the magnet axis, the flat portions of the second and third yokes, having mutually facing air gap surfaces are so spaced from each other, that the end portion of only one of said pole pieces provided with two air gap surfaces penetrates between the flat portions of said second and third yokes with substantially the said clearance, whereby, for only one end position of said armature, the magnetic flux of said magnet is caused to flow through the core, the pair of yokes and two air gaps disposed on either side of the magnet axis and closed for a first direction of movement of translation of the armature, whereas in the other end position of said armature, subjected to an external antagonist reaction, the magnetic circuit comprising the core and two of said yokes is closed, for the second direction of movement of the armature, by one of the two pole pieces and by two air gaps, without passing through the magnet.

The satisfactory operation and performances of this magnetic circuit, notably in the monostable operating conditions, is due to the fact that the creation of a magnetic flux opposed to that of a permanent magnet, in an auxiliary magnetic circuit which is closed and therefore more efficient, is substituted for the creation of a magnetic flux in a main magnetic circuit which is of the open circuit type, in order to counterbalance a return force.

A similar structure is disclosed in the French Pat. No. 2,086,852, but it is objectionable in that it has considerable over-all dimensions and cannot be applied to a bistable version. Moreover, it is advantageous to cause the magnetic flux of the magnet to circulate through two air gaps disposed in series.

The French Pat. No. 1,354,433 discloses on the other hand, a bistable magnetic circuit which is efficient but rather cumbersome since only one-half of the magnetic circuit is utilized at the same time.

The magnetic circuits described in the French Pat. Nos. 2,112,415 and 2,154,480 are of reduced over-all dimensions, but the magnet is fixed and relatively remote from the air gaps. Now it was found that due to unavoidable magnetic leakages the magnet efficiency could be improved considerably if the pole pieces are so designed that the air gaps can be set very close to and preferably on either side of the magnet.

This led to an arrangement comprising a movable magnet provided with pole pieces as described in the French Pat. Nos. 1,328,497 and 1,353,958. However, the two-magnet arrangement contemplated in the French Pat No. 1,328,497 is expensive and cumbersome, and when the magnetic circuit of a magnet cannot close systematically this magnet tends to undergo an irreversible demagnetization in cold surroundings. The arrangement contemplated in the French Pat. No. 1,353,958 has a good efficiency in bistable operation, but as the preceding arrangements, it cannot provide a structure suitable for monostable operation unless return springs are used. Moreover, it is difficult to properly position the pole surfaces, with respect to the axis of rotation of the armature so that the air gaps close simultaneously and completely, as explained in the French Pat. No. 2,237,301.

The various inconveniences mentioned in the foregoing are safely avoided by the present invention. Other features of this invention will appear as the following description proceeds with reference to the attached drawings illustrating typical embodiments of the invention, given by way of illustration, not of limitation.

DESCRIPTION OF THE PREFERRED EMBODIMENTS

Figure 1:
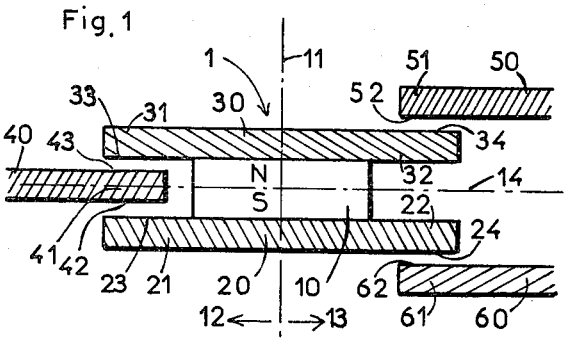
FIGS. 1 and 2 illustrate the essential component elements of a magnetic circuit according to the invention, with a typical embodiment for bistable operation being shown in FIG. 1) and a typical embodiment for monostable operation being shown in FIG. 2.
Figure 2:
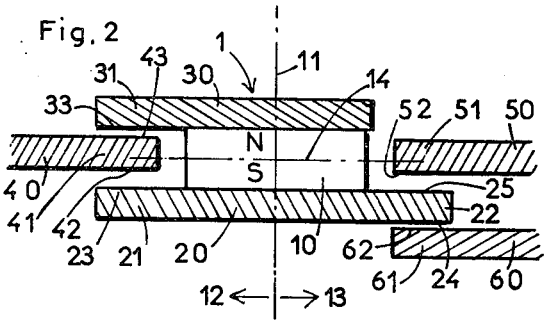

Referring first to FIGS. 1 and 2 of the drawings, the armature 1 comprises a permanent magnet 10 of parallelepipedic configuration, magnetized in the direction of an axis 11, and a pair of pole pieces 20 and 30 one being secured to the flux input face and the other to the flux output face, respectively, of the magnet. Both pole pieces 20 and 30 are substantially flat and disposed substantially normally to the magnet axis 11.

Yokes 40, 50 and 60 are connected to the free ends (not shown) of either a single core or a pair of cores magnetically interconnected in series. The yokes 40, 50 and 60 comprise flat portions 41, 51, 61 disposed in parallel planes.

In FIGS. 1 and 2, on a first side 12 of the magnet axis 11, the pole pieces 20, 30, have projecting end portions 21, 31 having mutually facing air gap surfaces 23, 33, and the flat portion 41 of the first yoke 40 has two air gap surfaces 42, 43, the flat portion 41 penetrating between the air gap surfaces 23, 33 of the end portions 21, 31 of pole pieces 20, 30, respectively with a clearance corresponding to the armature stroke when the latter moves along axis 11.

Also in FIGS. 1 and 2, on the second or other side 13 of magnet axis 11, second and third yokes 50, 60, both connected to a common free end of the core, have flat portions 51, 61 having mutually facing air gap surfaces 52, 62 between which two air gap surfaces belonging to at least one of the pole pieces 20, 30 are caused to extend or penetrate.

The air gap surfaces of the end portions of the pole pieces 20, 30 and of the flat portions of the yokes 40, 50, 60 are perpendicular to the magnet axis 11. The direction of movement of the armature 1 corresponds substantially to the magnet axis 11 and this movement can take place between two end positions each defined by the closing of air gaps formed between the pole pieces and the flat portions of the yokes. For each end position, a magnetic coupling is thus established between the first yoke 40 disposed on the first side 12 of the magnet 10 and either of said second and third yokes 50, 60 disposed on the second or other side 13 of the magnet 10.

More particularly, in the embodiment illustrated diagrammtically in FIG. 1, on the second side 13 of the magnet axis, the flat portions 51, 61 having mutually facing air gap surfaces 52, 62 are suitably spaced to permit the penetration therebetween, with substantially the said clearance, of the end portions 22 and 32 of both pole pieces 20 and 30, each provided with an outwardly facing air gap surface 24, 34 respectively. With such an arrangement, in the lowermost position of the armature 1, the magnetic flux from the magnet face "N" will flow in succession through the end portion 31 of pole piece 30, the air gap formed between surfaces 33 and 43, the flat portion 41 of first yoke 40, the core or cores (not shown), the flat portion 61 of the third yoke 60, the air gap formed between the surfaces 62 and 24, and the end portion 22 of pole piece 20 to the magnet face "S". Both air-gaps 33, 43 and 62, 24 which are disposed on either side and in close vicinity of the magnet axis 11, will thus produce forces having the same direction and tending to hold the armature 1 in its lowermost position.

Similarly, in the uppermost position of the armature 1, the magnetic flux from the "N" face of the magnet 10 will flow in succession through the end portion 32 of pole piece 30, the air gap formed between surfaces 34 and 52, the flat portion 51 of the second yoke 50, the core or cores (not shown), the flat portion 41 of the first yoke 40, the air gap formed between surfaces 42 and 23, and the end portion 21 of pole piece 20 to the magnet face "S". Both air gaps 34, 52 and 42, 23 which are disposed on either side and in close vicinity of the magnet 10, will also produce forces having the same direction but tending in this case to hold the armature 1 in its uppermost position.

It will also be seen that the direction of travel of the magnetic flux through the core or cores is inverted when the armature is caused to move from one to the other of its extreme positions.

Therefore, a bistable-operating magnetic circuit structure is obtained, of which the bistable operation can be controlled by causing a current of one polarity or of the reverse polarity to flow through at least one winding surrounding at least one core.

In the embodiment shown in FIG. 2, on the second side 13 of the magnet axis 11, the flat portions 51, 61 having mutually facing air gap surfaces 52, 62 are closer to each other, so that only the end portion 22 of pole piece 20 provided with two opposed air gap surfaces 24, 25 is caused to penetrate therebetween with substantially the said clearance or play.

In FIG. 2, the armature 1 is shown in its nearly lowermost position. In this position, it will be seen that the magnetic flux path is the same as in the case of the corresponding position in FIG. 1.

On the other hand, in the uppermost position of armature 1, a direct magnetic coupling (without passing through the magnet 10) is established between the yokes 40 and 50, through the pole piece 20 and air gaps 23, 42 and 25, 52. These air gaps also closed simultaneously. In this position, the pole piece 30 is no longer in contact with another portion of the magnetic circuit and the flux path from magnet 10 must compulsorily close itself in the air.

When the armature 1 is in its lowermost position (FIG. 2), which is the rest position, if a winding surrounding the core is energized with a polarity such that the magnetic flux thus produced tends to counteract the magnet flux, the magnet force which kept the armature in its rest position is reduced, or even a repelling force may be created. When the armature 1 subsequently approaches its uppermost or operative position, an electromagnetic pull force as in a conventional electromagnet is created. When the winding energization is discontinued, the magnet restores the armature to its rest or inoperative position. However, to overcome a possible residual pull force it is preferable that an antagonistic reaction force be applied to the armature when the latter is close to this operative position. This reaction force may result, for example, from the compression effort of contacts in the case of a relay or contactor. A residual air gap may also be provided.

Thus, a circuit structure designed for monostable operation is obtained, but the polarity of the control current in the winding is laid down. It may be noted that this structure differs from the bistable-operating magnetic circuit structure of FIG. 1 only through minor changes in the magnetic circuit.

It is essential that the air gaps close completely, throughout their surface area for each end position of the armature or at least for each stable end position thereof when no energizing current is supplied. Since it is easier to obtain parallel surfaces, it is preferable that the air gap spacing be the same on both sides of axis 11, and this leads to adopt a movement of translation of the armature 1 along axis 11. However, it is also possible to use unequal air gap spacing, and also air gap surfaces that are not exactly parallel to each other, thus causing the armature 1 to perform a movement of rotation of which the axis is located in the median plane 14, outside the area occupied by the pole pieces 20, 30.

The fact of disposing of two air gaps on either side of the magnet, with each air gap producing a force, increases the force available for a given magnet, in comparison with a structure in which the magnetic flux of the magnet is caused to pass through only one air gap, as in the case of the above-mentioned French Pat. Nos. 2,086,852 and 1,354,433.

When the distance to be covered by the flux from the magnet to an air gap is considerably greater than from the output of a coil to an air gap, as in the case of the French Pat. Nos. 2,154,480 and 2,237,301, it was found that the direction of travel of the magnet flux through an air gap can be reversed by means of a sufficient energization of the coil, without causing any movement. In fact, the coil flux path is closed in this case by leakages through the air after passing through the air gap, while the magnet flux path is closed by other leakages through the air. Instead of obtaining a repelling force, another pull force of the same direction as the preceding one is created.

Now this inconvenience cannot occur with the arrangement according to the invention, since the air gap is located as close as possible to the magnet. The air gap surfaces on either side of the magnet axis are not forcibly identical. On the contrary, when it is desired to have identical forces on either side of the magnet, the arrangement may be such that on one side 13 the air gap surface area can be somewhat smaller in order to compensate the effect of leakages that are slightly greater on this side.

Similarly, in the arrangement of FIG. 2, the air gap surfaces in the upper or operative position may differ from those in the lower or rest position.

In the case of a ferrite magnet, such as a barium ferrite, due to the very moderate thickness that can be given to this magnet, it is possible to have for the armature 1 a stroke (plus the thickness of the flat portion 41 between the air gap surfaces 42, 43) exactly equal to the magnet height. As a result, the pole pieces 20, 30 may have strictly flat faces. By avoiding the bending of these pole pieces, the addition of tolerances, likely to produce incomplete air gap closings, can be reduced appreciably.

By way of example, with a 2-mm high magnet and an iron cross-sectional area of less than 10 sq.mm, it is possible to obtain forces of a few newtons moving through a distance of 1 mm under a control signal corresponding to less than 100 ampere-turns. Alternatively, with a 5-mm high magnet and an iron cross-sectional area of a few tens of square millimeters, it is possible to obtain forces of more than 5 newtons moving through a distance of 3 mm under a control signal corresponding to less than 200 ampere-turns.

Now different magnetic circuit arrangements will be described which utilize the above-described structure of an armature associated with flat yoke portions, each arrangement offering specific advantages with respect to the space available, the number and mutual positions of the members to be controlled, the machining tolerances, the ease of assembling the various elements, etc.

Figure 3:
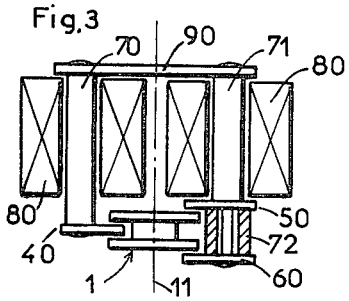
FIG. 3 illustrates an electromagnet according to a first embodiment of the invention, provided with an armature and designed for bistable operation.

FIG. 3 illustrates a first embodiment in which a pair of parallel cores 70, 71 are assembled at one of their ends by a magnetic member 90. The cores are each surrounded by a coil 80 comprising at least one winding in order to constitute an electromagnet. The yokes 40, 50 and 60 have a flat shape and extend at right angles to the longitudinal axes of the cores. The yoke 40 is for instance crimped on the free end of core 70, the latter comprising for example a shoulder and a stud for this purpose. Similarly, the other yokes 50 and 60 are secured to the free end of core 71. To obtain the proper relative spacing and parallel relationship between the yokes 50 and 60, a member such as a hollow spacing member 72 having parallel end faces may be interposed, as shown. The end of core 71 is conveniently extended by a stud to provide another fixing, for example also by crimping. The armature 1 is shown as being of the bistable type illustrated in FIG. 1, but of course it may as well be of the monostable type as shown in FIG. 2. Obvious, guide means (not shown) must be associated with the armature 1 so that the latter can move along its axis 11. This guiding action may be obtained for example by using a valve shank in the case of a solenoid valve, or movable blades pivoted at one end in the case of a relay.

Figure 4:
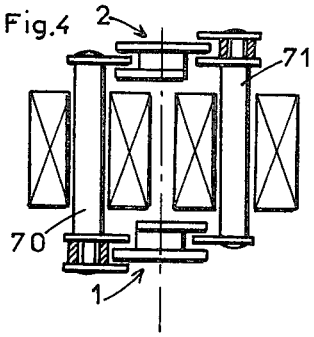
FIG. 4 illustrates an electromagnet similar to that of FIG. 3, but provided with two armatures and intended for monostable operation.

In FIG. 4, a second armature 2 is substituted for the magnetic coupling member 90 of FIG. 3, and both cores 70 and 71 have been provided with yokes at either end. In this example, the armatures 1 and 2 are shown as being of the monostable type, as shown in FIG. 2. They can be disposed either symmetrically in relation to a plane, or symmetrically in relation to a point, so that the two cores will have identical shapes. Of course, in this case the two armatures 1 and 2 must be of the same type.

Figure 5:
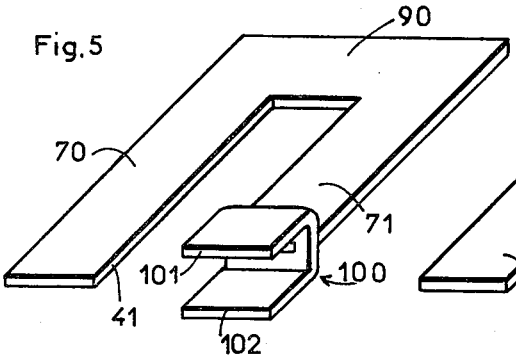
FIG. 5 illustrates, in perspective view, a magnetic circuit according to a second embodiment of the invention, designed for bistable operation, the armature being omitted therefrom.

FIG. 5 shows, in perspective view, a second embodiment in which the two parallel cores 70, 71 have a rectangular cross-section and form with the magnetic coupling member 90 an integral U-shaped member obtained for example by cutting or stamping from plate material.

The core 70 is provided with an integral extension which constitutes the flat portion 41 of the first yoke. If the armature (not shown) is of the bistable type, a U-shaped bent member 100 may be secured in the middle of its centre portion to the free end of core 71. The bent end portions 101 and 102 of member 100 constitute the flat portions 51 and 61 of the second and third yokes 50 and 60, respectively.

The planes of the flat portions of the yokes are parallel to the core plane. Of course, the member 100 is secured to the end of core 71 only after fitting the corresponding coil in position thereon.

Figure 6:
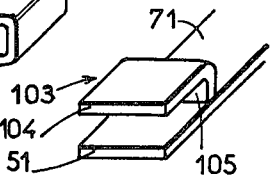
FIG. 6 illustrates the change to be brought to the embodiment of FIG. 5 for obtaining a monostable operation.

In the case of a monostable armature, the member 100 may be replaced by an angle member 103, as shown in FIG. 6. One arm 104 of the angle member 103 constitutes the flat portion 61 of the third yoke, and the other arm 105 is secured to the core 71. The core 71 has a flat, i.e. non-bent extension, constituting the flat portion 51 of the second yoke.

Figure 7:
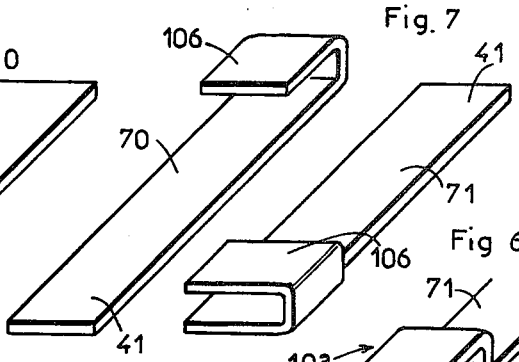
FIG. 7 illustrates a modified version of the second embodiment, comprising two armatures and designed for monostable operation.

As in the case illustrated in FIG. 4, the magnetic coupling 90 of FIG. 5 between two cores 70 and 71 may also be replaced by a second armature. FIG. 7 illustrates two cores 70 and 71 which may be associated with an armature of the monostable type at either end. In this case, an extension 106 of the free end of the corresponding core is substituted for the angle member 103, this extension being bent twice at right angles and in the same direction, the bending axes being parallel or perpendicular to the core axis. This is permitted by the fact that the coil can be set on the corresponding core from the other end of the core having the flat portion 41.

Figure 8:
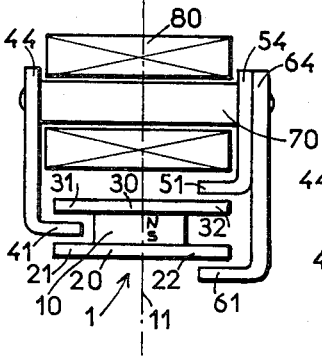
FIGS. 8 and 9 illustrates an electromagnet according to a third embodiment of the invention, for bistable and monostable operation, respectively.
Figure 9:
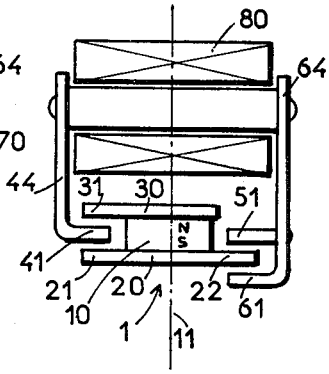

FIGS. 8 and 9 illustrate diagrammatically, for the bistable and monostable modes of operation, respectively, an electromagnet provided with a magnetic circuit corresponding to a third embodiment of the present invention. In this arrangement, the axis of the single core 70 is parallel to the flat yoke portions 41, 51 and 61. The yokes are bent at right angles, and have a first wing 44, 54, 64 secured to a free end of core 70, and a second wing 41, 51, 61 constituting the flat portion having at least one air gap surface. The second and third yokes may be coupled magnetically either through their wings 54 and 64 to the same core end, as shown in FIG. 8, or by having a common first wing 64, as shown in FIG. 9.

The other component elements shown in these Figures are the same as those already described in the foregoing.

Figure 10:
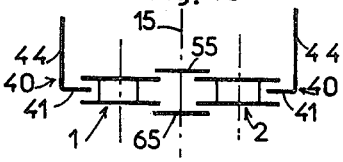
FIGS. 10 and 11 illustrates diagrammatically modified version of the embodiment shown in FIGS. 8 and 9, respectively, in the case of twin armatures.
Figure 11:
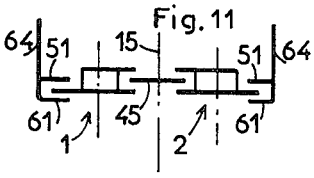

When it is desired to have two armatures in this third embodiment, for example with a view to control a higher number of contacts, it is possible to increase the relative spacing of the end yokes and to provide two armatures side by side having a common transverse median plane 14 (FIGS. 1 and 2), as shown diagrammatically in FIGS. 10 and 11.

In FIG. 10, the first yokes 40 shown diagrammatically in thick lines are disposed on either side of a pair of bistable armatures 1 and 2. Intermediate yokes 55, 65 are disposed between these armatures in the positions, the two wings 51, 61 of second and third yokes 50 and 60 would have occupied if the arrangement contemplated were intended to constitute two separate magnetic circuits disposed symetrically in relation to the plane 15 passing between the pair of armatures 1 and 2 and perpendicular to the planes of the flat portions of said yokes. If monostable armatures had to be utilized, it would have been sufficient to shift the intermediate yoke 55 to a position in which it is coplanar with the second wings 41 of the first yokes 40.

In FIG. 11 there are shown, also diagrammatically, two assemblies of second and third yokes having flat portions or wings 51, 61, disposed on either side of a pair of armatures 1, 2 of the monostable type. An intermediate yoke 45 coplanar with the wings 51 is provided between these armatures. It is clear that a corresponding arrangement with bistable armatures can be contemplated.

Figure 12:
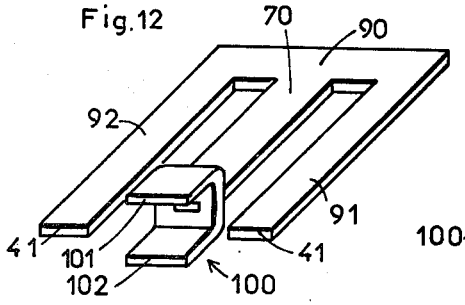
FIG. 12 illustrates, in perspective view, a magnetic circuit according to a fourth embodiment of the invention, designed for bistable operation, the armature being omitted therefrom.

FIG. 12 illustrates in perspective view a magnetic circuit (without armature) according to a fourth embodiment of the invention. Two lateral return arms 91, 92 are disposed on either side of, and parallel to, a central core 70 for returning the flux from one end of the core to the level of the opposite end of said core.

At one end, a magnetic coupling member 90 interconnects the lateral return arms 91, 92 and the central core 70. The core 70, member 90 and arms 91, 92 can be cut or stamped from a same and single metal blank to provide an E-shaped member. In the case illustrated in FIG. 12, the free ends of the lateral arms 91, 92 are provided with integral flat extensions which constitute the flat portions 41 of first yokes 40 of a pair of yoke assemblies, two armatures (not shown) conveying each one fraction of the core flux towards one of the return arms. Secured to the free end of the core 70 is a member 100 bent to a U shape, as already described, the bent wings 101 and 102 of member 100 constituting the flat portions 51, 61 of second and third yokes 50, 60 common to the two yoke assemblies.

Figure 13:
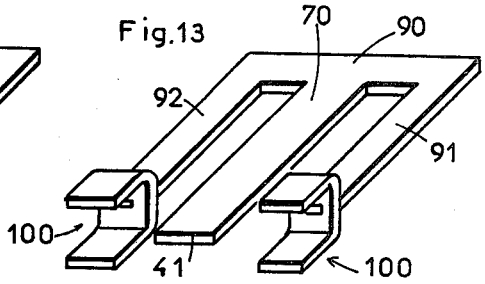
FIG. 13 illustrates a modified version of the embodiment shown in FIG. 12, also for bistable operation.

In FIG. 13, bent U shaped pieces 100 are carried by the lateral return arms 91, 92 and the free end of the core 70 constitutes the flat portion 41 common to both yoke assemblies.

Figure 14:
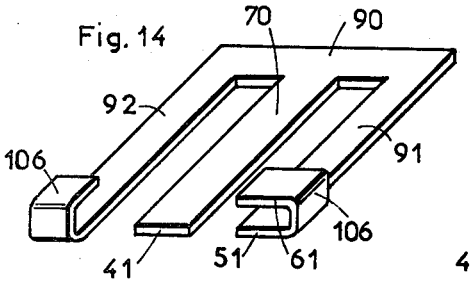
FIG. 14 illustrates a modified version of the embodiment shown in FIG. 12, designed for monostable operation.

In FIG. 14, in the case of a monostable operation, each flat portion 61 consists of a doubly bent extension of the corresponding return arm 91 or 92, as in the case illustrated in FIG. 7.

Figure 15:
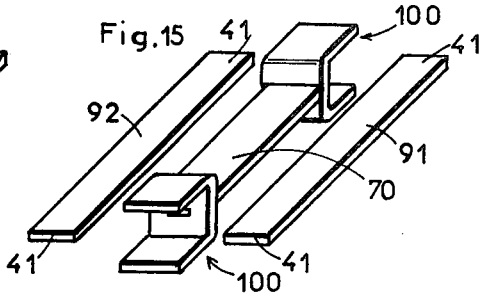
FIG. 15 illustrates another modified version of the structure shown in FIG. 12, designed for bistable operation with two armatures not shown.

In FIG. 15, the magnetic coupling 90 is replaced by a second two-armature assembly (not shown) associated with a second pair of yoke assemblies arranged in a similar fashion as the first pair of yoke assemblies. It will be seen that the core 70 could as well have a cylindrical configuration. Of course, in FIGS. 13 and 14, the magnetic coupling 90 can also be replaced by a second two-armature assembly.

Figure 16:
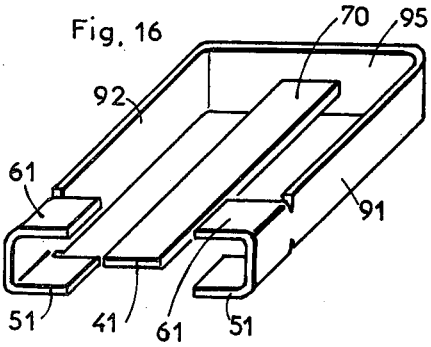
FIG. 16 illustrates, in perspective view, a magnetic circuit according to a fifth embodiment of the invention, designed for bistable operation, the armature being omitted.

A fifth embodiment of the invention is illustrated in FIG. 16 which differs from the one shown in FIG. 12 by the fact that the lateral return arms 91, 92 and the magnetic coupling 90 are formed integrally by a member bent to a U shape with the transverse section 95 thereof secured to one end of core 70. The latter has preferably a rectangular cross section and its plane is perpendicular to those of the pair of lateral return arms, as shown. The free end of the core 70 has an integral extension which constitutes the flat portion 41 of the first yoke common to the two yoke assemblies, and the free end of each lateral return arm 91, 92 is widened to a T-shape, of which the two end portions of the transverse section are bent at right angles towards the core 70 in order to provide the flat portions 51, 61 of the second and thrid yokes of the two yoke assemblies.

Figure 17:
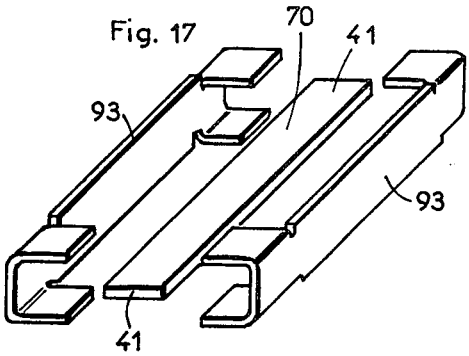
FIG. 17 illustrates a modified version of the embodiment shown in FIG. 16, also for bistable operation, but with two armatures.

FIG. 17 illustrates a magnetic circuit similar to that of FIG. 16 when the magnetic coupling 95 is replaced by a second two-armature assembly as in the case shown in FIG. 15.

Figure 18:
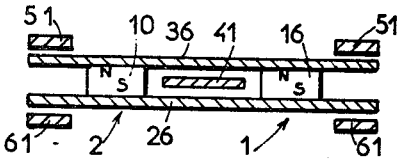
FIGS. 18 to 21 inclusive illustrates a double armature for a magnetic circuit according to the fourth or fifth embodiment.

FIG. 18 is an end view showing a bistable two-armature assembly and flat yoke portions 41, 51, 61 of magnetic circuits of the type illustrated in FIGS. 13, 14, 16 or 17.

Figure 19:
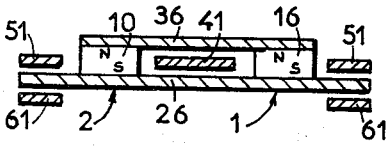

The pair of magnets 10 and 16 are disposed on either side of the flat end portion 41 of the core. FIG. 19 illustrates the modification to be brought to the arrangement of FIG. 18 for operating the device in the monostable mode of operation.

Figure 20:
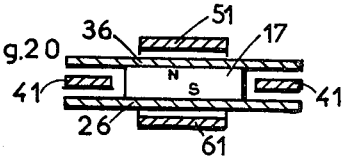
Figure 21:
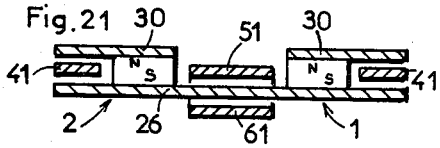

FIG. 20 is similar to FIG. 18, but for magnetic circuits of the type shown in FIG. 12 or 15. FIG. 21 shows the change to be brought to the assembly of FIG. 20 for obtaining a monostable mode of operation.

In FIGS. 18 to 21, it will be seen that the adjacent armatures of the two-armature assembly may be rigidly bound to each other by means of common pole pieces. Thus, a single member 26 may constitute the two pole pieces 20, whereas a single member 36 may constitute the two pole pieces 30.

Also in FIG. 20, it will be seen that the pair of magnets 10 and 16 may be brought as close to each other as to constitute a single permanent magnet. In the other cases illustrated, the two magnets 10 and 16 could also be common, provided that they are shifted to the front end of the flat yoke portion 41 or 51 by properly modifying the pole pieces.

Of course, other changes may be brought to the arrangements described hereinabove without departing from the field of the invention.

Thus, the core 71 of FIG. 5 may also act as a return arm and in this case no coil is carried thereby. Alternatively, the return arms 91 and 92 or 93 of FIGS. 12 to 17 may be used as cores, the central portion 70 constituting in this case a central return arm.

Moreover, in FIGS. 12 to 17, the air gaps formed between the pole pieces and the return arms, instead of being at the level of the core end, may be shifted towards the level occupied by the magnetic coupling 90. However, it is advantageous to minimize the leakage fluxes of the magnet or magnets.

On the other hand, the two adjacent armatures of FIGS. 18 to 21 may be interconnected only through a common flexible actuating member in order not to impede the complete closing of the air gaps, with due consideration for the dimensional tolerances. For the same purpose, the return arms of FIGS. 15 to 17 may be loosely mounted with respect to the core 70.

Besides, a mechanical coupling may be provided between two independent armatures, and the shock-proof property may be improved if accelerations produce opposite effects on the two coupled armatures.

Due to the provision of the biased magnet in the magnetic circuit, the coil 80 should be energized with D.C. or rectified current. If only an AC voltage is available, a rectifier for example of the type disclosed in the French Pat. No. 2,291,590 is particularly suited for the purpose, considering the sudden and complete armature movement, even in case of pulsated energization.

As already pointed out in the foregoing, it is essential not to impede the complete closing of the air gaps, considering the machining tolerances involved in the manufacture of the various component elements. More particularly, a precise control of the thickness tolerances of the magnet may prove difficult in the manufacture of miniature relays. It has been seen that, for this purpose, the lateral return arms may be losely mounted with respect to the core 70 when these arms are not rigid with said core, as in the cases illustrated in FIGS. 15 and 17.

Now other arrangements affording a complete closing of the air gaps without resorting to the loose assembling of some elements of the magnetic circuit, such as the return arms and cores, with one another, will be described with reference to FIGS. 22 to 25 of the drawings.

Briefly, the magnetic circuits illustrated in FIGS. 22 to 25 comprise on the one hand a first flat lamination a cut or stamped to provide some of the flat fixed elements including a core 70*a*, at least one return arm 91*a*, 92*a* and a magnetic coupling 90*a* between the core and the return arm or arms, and on the other hand another flat lamination b comprising at least one portion forming a return arm 91*b*, 92*b*, these two laminations a and b being superposed and assembled with a limited liberty of movement in a direction at right angles to the planes of said laminations, the flat portion 61*b* of the third yoke 60 being formed by the outermost portion of an extension, bent twice at right angles in the form of a bayonet, of the return arm forming portion (s) 91*b* (and 92*b*) of the second lamination b.

Figure 22:
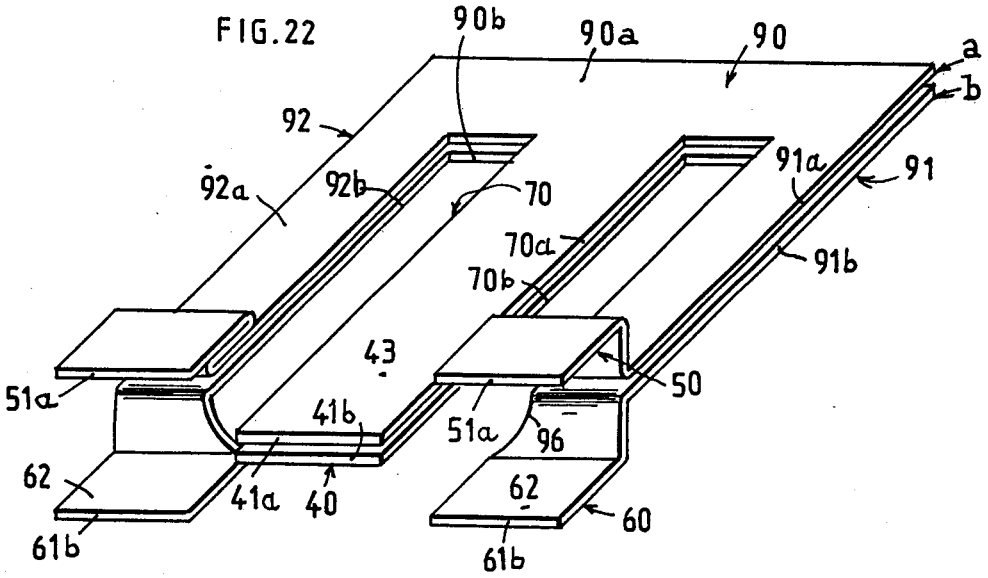
FIG. 22 illustrates, in perspective view a magnetic circuit according to a sixth embodiment of the invention, designed for bistable operation, the armature being omitted therefrom.

In FIG. 22, the general form of the magnetic circuit of FIG. 13 is reproduced, but the flat fixed elements of this magnetic circuit, comprising the core 70, the magnetic coupling 90 and the pair of lateral return arms 91 and 92 are obtained not from a single E-shaped flat sheet but from two parallel flat laminations superposed and assembled with a limited liberty of movement in a direction at right angles to the lamination planes. The reference letters a and b distinguish the preceding elements accordingly as they pertain to the first lamination a or to the second lamination b.

As in the arrangement shown in FIG. 13, the flat portion 41 of the first yoke 40 consists of a flat extension of core 70. However, the corresponding air gap surfaces 42 and 43, instead of belonging to the same piece as in the case shown in FIG. 13, now belong to two different pieces 41*a* and 41*b* (see also FIG. 23) In FIG. 23, it is clear that the relative spacing between the two air gap surfaces 42 and 43 depends on the slight clearance left between the two laminations a and b.

The second and third yokes 50 and 60, instead of resulting from U-shaped members 100 supported by the ends of the lateral return arms 91, 92, consist of twice bent extensions of the end portions of said return arms.

More precisely, the free end portions of the return arms 91*a* and 92*a* of the first lamination a are each provided with an extension which is bent twice to provide the upwardly offset bayonet shape illustrated. Symmetrically thereto, the downwardly offset bayonet-shaped extensions of return arms 91*b* and 92*b* comprise flat end portions 61*b* of which the inner surfaces constitute air gap surfaces 62 each of which face with a respective air gap surface 52, as illustrated in FIG. 23.

Figure 23:
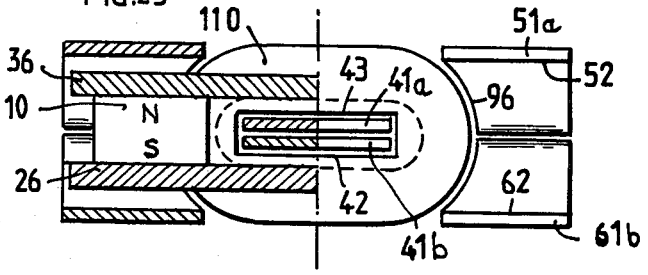
FIG. 23 is an end view of the magnetic circuit of FIG. 22, with the magnetic circuit partly shown in section on the left-hand side.

On the left-hand side of FIG. 23, a magnet 10 provided with pole pieces 26 and 36 is shown. The pole pieces 26 and 36 are common to a second armature (not shown) normally provided on the right-hand side of the Figure, with an arrangement similar to that of FIG. 18.

However, it will be seen that the magnet 10 is located partly between the mutually facing air gap surfaces 52 and 62 of the second and third yokes, in order to reduce the over-all dimensions. Moreover, the extensions of the return arms bent to a bayonet configuration have an intermediate portion of which the width increases following a rounded contour 96 corresponding to the shape of the flanges of a coil supporting carcass or spool 110 fitted around the core 70*a*, 70*b*. This increment in width permits rapidly obtaining an iron cross-section area matching that of the other parts of the magnetic circuit when the flux is caused to circulate through only one of the two laminations.

Another advantage of this arrangement is that it avoids a detrimental increase in the dimensions of the electromagnet thus constructed.

The coil supporting carcass 110 is provided with a central passage of rectangular cross-section corresponding to the core cross-section. However, the width of this rectangular cross-section is slightly greater than the sum of the thicknesses of core-forming portions 70*a*, 70*b* of the two laminations a and b. The clearance thus created provides for the above-mentioned limited liberty of movement in a direction at right angles to the plane of the laminations. Said clearance may be for example more than one-fifth, and less than one-half, of the thickness of a single lamination.

When analysing the mode of operation of the electromagnet shown in FIGS. 22 and 23 from the specific point of view of the complete closing of the air gaps thereof, it will be seen that when the pole piece 36 is for instance pressed against the surfaces 52 of the first lamination a, the air gap surface 42 belonging to the second lamination b can move slightly upwards or downwards in order to engage the central portion of the inner surface of the pole piece 26, thus making up possible dimensional dispersions on the height of the magnet, the thickness of the pole pieces and laminations, and also on the off-set of the bayonet-shaped bent portions. It is only necessary that the play contemplated can take up the maximum stacking or sum of the tolerances.

In practice, the above-described arrangement amounts to replacing a residual air gap associated with an active air gap surface, which has a substantial influence on the magnetic circuit performances, by an air gap value at the most equivalent thereto but distributed all over the surface area common to both laminations. The stray magnetic reluctance thus created has but a negligible repercussion on the magnetic circuit performances.

Therefore, with the arrangement of FIGS. 22 and 23, it is possible to dispense with the costly cares necessary for reducing manufacturing tolerances. Moreover, the use of inserts as members 100 and any accurate right-angle bending of pieces are avoided. The only requirement set on bayonet-shaped bended portions is to have parallel end faces. Finally, in the case illustrated in FIG. 22, the two laminations are identical. In short, the manufacture of this electromagnet is greatly simplified.

To obtain a monostable operation, it is necessary to change the off-set of the bayonet portions of the first lamination a in such a way that the surfaces 52 be coplanar with the surface 42, somewhat as in the case illustrated in FIG. 2. Moreover, to leave enough room for the magnet, the flat portion 51*a* should be shifted laterally away from the core. However, it is no longer necessary to increase the width of the flat portion 51*a*, since this portion is operative only when the coil is energized, i.e. when the force available is greater than when the flux is supplied only by the magnet or magnets.

Instead of resulting from the inner width of the rectangular cross-section of the central hole of the coil supporting carcass 110, the limited liberty of movement of the two laminations may also result from members such as rivets or studs projecting from an insultating base, with the interposition of a suitable spacing member when rivetting, said spacing member being removed after rivetting.

The loss of armature stroke due to the relative movement of the two laminations a and b is scarcely detrimental as far as the electromagnet performances are concerned, since a preliminary increment in the armature stroke does not result in a weaker force at the end of the stroke or in a higher power consumption, as in conventional electromagnets equipped with return spring means.

Figure 24:
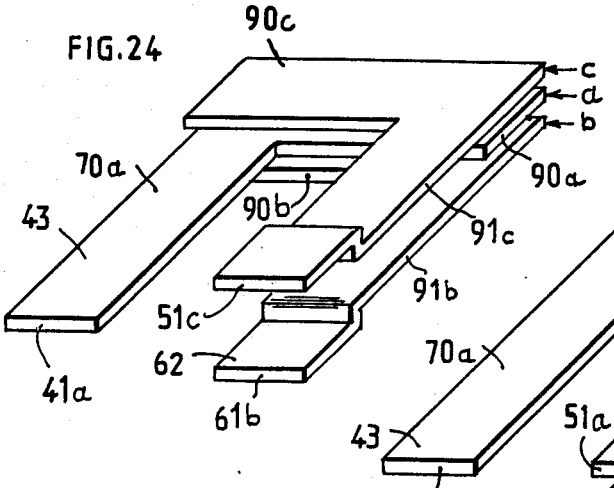
FIGS. 24 and 25 illustrate, in perspective view, magnetic circuits according to another embodiment of the present invention, for bistable operation (FIG. 24) and monostable operation (FIG. 25), the armature not being shown.

It would not constitute a departure from the present invention to provide only one return arm 91 in the magnetic circuit of FIG. 22, somewhat in the fashion of the magnetic circuit illustrated in FIG. 24.

In this Figure, it will be seen that the first lamination a has no return arm forming portion and that the second lamination b has no core forming portion. Moreover, a third lamination c superposed to, and assembled with, the other two laminations a and b, also with a limited liberty of movement in a direction at right angles to the lamination planes, is provided. The third lamination c has no core forming portion, but comprises a magnetic coupling forming portion 90*c* and a return arm forming portion 91*c*.

The flat portion of the second yoke consists of the end 51*c* of a bayonet-shaped bent extension of the return arm forming portion 91*c*.

Since the core 70*a* comprises only one lamination, a coil supporting carcass can be molded thereover, because before assembling the second and third laminations nothings prevents the coil from being wound directly on the over-molded carcass. Thus, the coil height can be reduced, and this is advantageous since the coil is the highest components in a flat relay.

Figure 25:
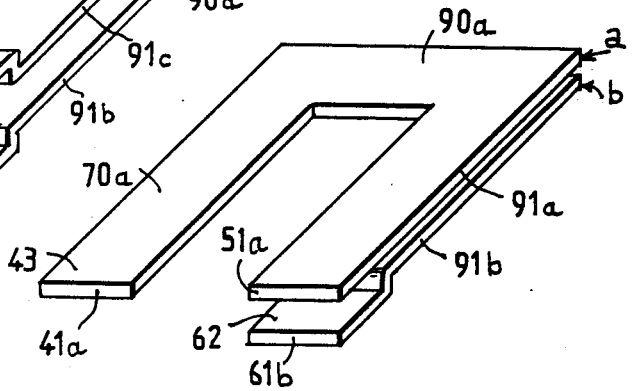

It is also possible to provide the first lamination a with a return arm 91*a* as that shown in FIG. 25, but shorter than the latter, in order to increase the mutually facing surface areas of the three laminations, thus facilitating the passage of flux from one lamination to another. But in this case it is not possible to use an over-molded coil supporting carcass.

It may also be seen that the width of the magnetic coupling 90 may be reduced since this coupling is obtained by a stack of two or three laminations.

In the case of a monostable operation, the third lamination c may be dispensed with as illustrated in FIG. 25, and the flat portion of the second yoke consists in this case of a flat extension of the return arm 91*a* of the first lamination.

Of course, a second return arm disposed symmetrically in relation to the core, may be added to the magnetic circuits of FIGS. 24 and 25 without departing from the basic principles of the invention. Moreover, a return arm may be used as a core if it can be provided with a coil, or vice versa. More particularly, with the arrangement shown in FIG. 25, it would be possible to slip a coil on the arm 91*a* and then fit the piece 91*b* in position.

What is claimed as new is:

1. A magnetic circuit for a direct current electromagnet such as a relay electromagnet, comprising a fixed core, two yokes each connected to a respective free end of the core, and at least one armature movable between two end positions, said armature comprising a permanent magnet having flux input and output faces disposed at right angles to the magnet axis and each provided with a pole piece, each yoke having a flat portion having at least one air gap surface, the flat portions of the yokes being located in substantially parallel planes, said pole pieces having projecting end portions provided with air gap surfaces located on either side of the magnet axis, the flat portion of a first one of said yokes having two air gap surfaces and penetrating, with a clearance corresponding to the armature stroke, between the two mutually facing air gap surfaces of two end portions of the pole pieces located on a first side of the magnet axis, wherein the gap surfaces of the end portions of the pole pieces and of the flat portions of the yokes extend at right angles to the magnet axis, the armature is movable for translation in a direction corresponding substantially to the magnet axis, and, on a second side of the magnet axis, a second one of said yokes and a third yoke, both supported by a common free end of the core, have flat portions provided with mutually facing air gap surfaces between which two air gap surfaces belonging to at least one of the two pole pieces penetrate with a clearance substantially equal to the above-mentioned clearance.

2. A magnetic circuit as claimed in claim 1, wherein on said second side of the magnet axis the flat portions of the yokes having mutually facing air gap surfaces are so spaced from each other to accomodate therebetween with substantially the said clearance the end portions of the two pole pieces each provides with an external air gap surface, so that, for each end position of said armature, the magnetic flux of the magnet is caused to flow through the said core, two of said yokes and two air gaps which are located on either side of said magnet and which are closed for a same direction of movement of translation of said armature, and so that the direction of flow of the magnetic flux of the magnet through said core is inverted when said armature moves from one end position to the other end position.

3. Magnetic circuit as claimed in claim 1, wherein said armature is subjected to an external antagonistic reaction for at least one of the end positions, and wherein, on said second side of the magnet axis, said second and third yokes are located on either side of one portion of only one of said two pieces, and the two mutually facing air gap surfaces of said second and third yokes are so spaced from each other to provide substantially the said clearance with respect to two opposite air gap surfaces belonging to said one end portion of said only one pole piece, so that, for only one of the end positions of the armature, the magnetic flux of the magnet is caused to flow through the core, two of said yokes and two air gaps which are disposed on either side of the magnet and which are closed for a first direction of movement of translation of the armature, and so that, for the other end position of the armature subjected to said external antagonistic reaction, the magnetic circuit comprising the core and two of said yokes is closed for the second direction of movement of the armature by a pole piece and two air gaps without passing through the magnet.

4. Magnetic circuit as claimed in claim 1, comprising two cores magnetically coupled in series with each other and having parallel axes, the planes of the flat portions of said yokes extending at right angles to the core axes, said yokes having a flat configuration and the second and third yokes being maintained parallel, at a predetermined relative spacing, by a hollow spacing member interposed therebetween and supported by an extension of the free end of the corresponding core.

5. Magnetic circuit as claimed in claim 1, comprising two co-planar cores magnetically coupled in series with each other and having parallel axes and rectangular cross section, the planes of the flat portions of said yokes being parallel to the plane of said cores, at least one of said yokes consisting of the non-bent extension of a free end of one of said cores.

6. Magnetic circuit as claimed in claim 4, wherein all the ends of the cores are free and support yokes, the magnetic series connection between the two cores comprising a second armature disposed symmetrically in relation to the first armature.

7. Magnetic circuit as claimed in claim 5, wherein all the ends of the cores are free and support yokes, the magnetic series connection between the two cores comprising a second armature disposed symmetrically in relation to the first armature.

8. Magnetic circuit as claimed in claim 1, wherein said core has an axis parallel to the planes of the flat portions of said yokes, said yokes being bent at right angles to have an L shape with a first wing secured to a free end of said core and a second wing constituting the flat portion having at least one air gap surface.

9. Magnetic circuit as claimed in claim 7, wherein said second and third yokes have a common first wing.

10. Magnetic circuit as claimed in claim 8, comprising two armatures disposed side by side and having a common transverse median plane, said armatures being disposed between two first yokes, being disposed between said armatures.

11. Magnetic circuit as claimed in claim 8, comprising two armatures disposed side by side and having a common transverse median plane, said armatures being disposed between to pairs of second and third yokes, a flat intermediate yoke being disposed between the two armatures.

12. Magnetic circuit as claimed in claim 1, comprising a pair of lateral return arms parallel to the core axis and magnetically coupled through a magnetic coupling to one end of said core, and wherein the planes of the flat portions of the yokes are parallel to a plane containing the axes of the return arms, and two assemblies each comprising first, second and third yokes are carried by free ends of said return arms and of said core, two armatures being each associated with a respective one of said assemblies, whereby the magnetic flux from said free end of the core is distributed in equal proportions between on the one hand a first one of said armatures and one of said return arms, and on the other hand a second one of said armature and the other of said return arms.

13. Magnetic circuit as claimed in claim 12, wherein the two armatures have at least one common pole piece.

14. Magnetic circuit as claimed in claim 12, wherein the two armatures have two common pole pieces and a common magnet.

15. Magnetic circuit as claimed in claim 12, wherein said core, said return arms and said magnetic coupling between said core and the return arms comprise a lamination cut to an E-shaped configuration.

16. Magnetic circuit as claimed in claim 12, wherein said return arms and the magnetic coupling comprise a piece of sheet material bent to a U-shaped configuration, the core being secured at right angles to the transverse portion of the U.

17. Magnetic circuit as claimed in claim 12, wherein all the ends of said core and said return arms are free and carry yoke assemblies, the magnetic coupling between the core and the return arms comprising another pair of armatures disposed symmetrically in relation to the first of armatures.

18. Magnetic circuit as claimed in claim 17, wherein the core comprises a flat, rectangular lamination, each return arm comprises a sheet metal member so disposed that the plane of said core extends at right angles to each return-arm forming member, each end of said core having an extension constituting the flat portion of a first yoke common to two yoke assemblies, each return-arm forming member having its two ends widened to a T-shaped configuration with each end portion of the transverse portion of said T being bent once at right angles towards the core in order to form the flat portions of the second and third yokes of each yoke assembly.

19. Magnetic circuit as claimed in claim 1, wherein the magnet is a ferrite magnet such as barium ferrite, the stroke of the armature plus the thickness of the flat portion of said first yoke corresponding to the height of the magnet in the axial direction thereof.

20. Magnetic circuit as claimed in claim 1, comprising a first lamination cut to have some flat fixed elements including a core, at least one return arm and a magnetic coupling between said core and return arm, and a second lamination comprising at least one portion forming a return arm, said second lamination being superposed to, and assembled with, said first lamination with a limited liberty of movement therebetween in a direction at right angles to the plane of said laminations, the flat portion of said third yoke being formed by an end portion of an extension, bent twice at right angles in the form of a bayonet, of the return arm forming portion of said second lamination.

21. Magnetic circuit as claimed in claim 20, wherein each of said first and second laminations comprises a core-forming portion, at least one return-arm forming portion and a magnetic-coupling forming portion, and wherein the flat portion of said first yoke is formed by flat, non-bent extensions of the core forming portions of said first and second laminations, and the flat portion of the second yoke is formed by an end portion of a bayonet-shaped extension of the return-arm forming portion of the first lamination.

22. Magnetic circuit as claimed in claim 20, wherein said first lamination comprises a core-forming portion and a magnetic-coupling forming portion, the flat portion of the first yoke being formed by a flat non-bent extension of the core-forming portion of said first lamination, the second lamination further comprising a magnetic-coupling forming portion, and a third lamination is provided with at least one return-arm forming portion and a magnetic-coupling forming portion, said third lamination being superposed to, and assembled with, said first and second laminations with a limited liberty of movement in a direction at right angles to the planes of said laminations, the flat portion of the second yoke being formed by an end portion of a bayonet-shaped bent extension of the return-arm forming portion of said third lamination.

23. Magnetic circuit as claimed in claim 22, wherein said first lamination also comprises a return-arm forming portion.

24. Magnetic circuit as claimed in claim 20, wherein said first lamination comprises a core forming portion, at least one return-arm forming portion and a magnetic coupling forming portion, the flat portions of the first and second yokes being formed by non-bent extensions of the core forming portion and of the return arm forming portion of the first lamination, respectively.

25. Magnetic circuit as claimed in claim 21, comprising a coil supporting carcass provided with a central hole of rectangular cross section having a width slightly greater than the sum of the thicknesses of the core forming portions of the two laminations, in order to permit said limited liberty of movement.

26. Magnetic circuit as claimed in claim 25, wherein said coil supporting carcass comprises end flanges having a rounded external contour, the bayonet-shaped bent extensions of the return arm forming portions of said first and second laminations having each an intermediate portion of which the width increases following a rounded contour matching the corresponding contour of the flanges of said coil supporting carcass.

* * * * *